US006840689B2

(12) United States Patent
Barrus et al.

(10) Patent No.: US 6,840,689 B2
(45) Date of Patent: Jan. 11, 2005

(54) THERMAL PRINTER WITH IMPROVED TRANSPORT, DRIVE, AND REMOTE CONTROLS

(75) Inventors: Gordon B. Barrus, San Juan Capistrano, CA (US); Dennis R. White, Fountain Valley, CA (US); Kevin P. Moore, Irvine, CA (US)

(73) Assignee: Printronix, Inc., Irvine, CA (US)

( * ) Notice: Subject to any disclaimer, the term of this patent is extended or adjusted under 35 U.S.C. 154(b) by 34 days.

(21) Appl. No.: 10/281,716

(22) Filed: Oct. 28, 2002

(65) Prior Publication Data

US 2003/0049065 A1 Mar. 13, 2003

Related U.S. Application Data

(63) Continuation of application No. 09/599,478, filed on Jun. 23, 2000, now abandoned, which is a continuation-in-part of application No. 09/323,169, filed on May 17, 1999, now Pat. No. 6,082,914.

(60) Provisional application No. 60/136,643, filed on May 27, 1999.

(51) Int. Cl.[7] ..... B41J 33/14

(52) U.S. Cl. ..... 400/234; 400/236

(58) Field of Search ..... 400/192, 233, 400/232, 234, 247, 248, 236, 236.2

(56) References Cited

U.S. PATENT DOCUMENTS 4,532,524 A * 7/1985 Yana et al. ..... 347/217
5,137,377 A 8/1992 Ito
5,366,303 A 11/1994 Barrus
5,366,307 A 11/1994 McGourty
5,490,638 A 2/1996 Driftmyer
5,542,769 A * 8/1996 Schneider et al. ..... 400/225
5,634,731 A 6/1997 Kita
5,788,384 A 8/1998 Goodwin
5,820,277 A 10/1998 Schulte
5,921,689 A 7/1999 Buckby
5,956,067 A * 9/1999 Isono et al. ..... 347/176
6,082,914 A 7/2000 Barrus
6,361,228 B1 3/2002 Barrus
6,384,854 B1 * 5/2002 Ibs et al. ..... 347/211

* cited by examiner

*Primary Examiner*—Anthony H. Nguyen
(74) *Attorney, Agent, or Firm*—MacPherson Kwok Chen & Heid, LLP; Tom Chen

(57) ABSTRACT

A thermal printer utilizing a platen on which media can move over a print head in association with print ribbon from a supply spool driven by motors connected to a print ribbon supply and take-up with a program to provide current settings and engine control to the ribbon. The printer further has a ribbon support, a program, and a processor connected to a drive for causing the drive to move the support in response to ribbon width. The printer has a control panel, a file system with current settings connected to the file system, and further includes engine control software for controlling the printer functions including print head pressure, print head temperature, and a ribbon support based upon the width of the print ribbon.

20 Claims, 12 Drawing Sheets

THERMAL PRINTER WITH IMPROVED TRANSPORT, DRIVE, AND REMOTE CONTROLS

This application is a Continuation of Ser. No. 09/599,478 filed Jun. 23, 2000 abandoned which is a Continuation-in-part of Ser. No. 09/323,169 filed May 27, 1999 now U.S. Pat. No. 6,082,914 and claims benefit of Ser. No. 60/136,643 filed May 27, 1999.

BACKGROUND OF THE INVENTION

1. Field of the Invention

This invention relates to printers which place a series of dots on underlying media to form a pattern, alpha numeric symbols, or a bar code. It relates more to those types of printers which are thermal printers wherein a print ribbon having a wax or other displaceable material thereon can be heated and disposed on an underlying media for printing thereon. Such underlying media can comprise paper, plastic, a web supporting a plurality of labels, or other media. The invention specifically relates to the print ribbon transport and drive control in a consistent manner to avoid various printing inconsistencies as well as an improved controller. Such printing inconsistencies can be light or dark print, improper alpha numeric symbols, or fuzzy printing as well as bar codes having either unclear or improper separations. This invention is in the field of the transport of the print ribbon, media, drive thereof, and control from a remote location.

2. Description of the Prior Art

The prior art of thermal printers relied upon various brakes, clutches, supports, and other apparatus in order to provide for the proper transport and drive of the print ribbon. The print ribbon has material thereon such as a wax or other type of heat sensitive material which can be used to imprint underlying media. The print ribbon has a very flexible and thin consistency. It borders on the fineness of a film like material of a flexible plastic sheet. Thus the print ribbon web should be maintained in a uniform and consistent position with respect to the web.

Disposed on the print ribbon is the print substance which must be disposed on underlying media. The substance of the print ribbon which is disposed under heated conditions is placed on the underlying media. It is placed at discrete points that must be accurately maintained. The accuracy is with regard to alpha numeric representations and particularly with regard to bar codes which have to be properly read.

During the process of displacement of the substance from the print ribbon, a heating element is used. The heating element can be an elongated bar having very discrete heating elements that conform to a certain number of dots per inch as desired. Such dots per inch in the way of heating elements can range up to six hundred dots per inch and more.

The print ribbon when passing under the heating element or printer head and on top of an underlying media and before and after is subject to wrinkling, striations, displacement, stretching, and other distortions. This is caused by tension, inertia, and other elements in the drive and transport systems and mechanism. In the past, it has been customary to compensate for these distortions with various clutches, controls, and supports. These mechanical elements which although workable in some cases did not always provide the best results. The distortions even after passing through the printer head are propagated backwardly to the printer head. Also, there was generally no way to compensate for this on a remote basis and/or as a real time function.

Further complicating this matter is the fact that the underlying media that is to be printed on must be driven over a platen which is a rotatable platen formed of a hard elastomeric material against which the print ribbon is guided and heated by the heating elements of the print head. Oftentimes, the print ribbons become mismatched with the underlying media, and distortions occur in a bar code which can be quite severe.

This invention utilizes a positive drive system for the print ribbon by a pair of D.C. brush motors that drive the take-up and supply spools. The motor velocities are measured by circuits that measure the Back EMF (BEMF) voltage of the motor drives. The movement and monitoring of the print ribbon can then be derived from the spool radius and the motor torque, as well as inertia and other dynamic aspects including the mass of the rolls on both the take-up and supply spools.

In order to maintain a print ribbon web without striations, stretched areas, or ridges and valleys, this invention incorporates a unique transport and drive system for the ribbon. This includes spring biased rollers in order to remove ribbon distortions. Also in order to balance the edges of the ribbon a gimbaled support that can be a roller is provided. Further to this extent, a remote control system is utilized to account for variables and corrections in the printing process.

An object of this invention is the control of the tension, movement and consistency of the print ribbon web. It is particularly important as it passes through the print head and over the underlying media that is to be printed.

A further enhancement is that the ribbon tension can be varied and maintained as to differently sized ribbon widths. The tension and movement is maintained on the print ribbon by means of rollers and a gimbaled or pivotal support. Also variable sized ribbons and media can be adjusted for automatically.

An object of this invention avoids prior art deficiencies by lessening print ribbon wrinkle. This is enhanced by rollers, and proper support across the width of the print ribbon web.

Another object of this invention is that it provides for tensioning and uniformity across the width of the print ribbon web. When prior art mechanical devices are used to maintain tension, especially friction type devices, another mechanism needs to be added to maintain the tension. This is usually a spring wrapped around a hub. This invention removes the need for this additional mechanism.

The invention provides rollers or other surfaces mounted on springs and/or gimbals or pivots which help to remove plastic ribbon set, striations, wrinkles, and inconsistencies from the ribbon. This is accomplished by working and guiding the ribbon in two different directions as it is taken off the feed spool, and balancing support across the width of the ribbon.

The support of the ribbon across its width is enhanced by a gimbaled or pivotal support that can be a plate, rod or roller. The center pivot of the gimbal can be adjusted by a motor or manually to accommodate various widths and edge dimensions of the print ribbon.

Finally, an automatic sensing and feedback system to control the printer is provided so that ongoing adjustments can be maintained to improve print quality and variably sized relationships.

SUMMARY OF THE INVENTION

In summation, this invention is a thermal printer, drive and transport system having rollers which help to remove plastic print ribbon inconsistencies from the spool while maintaining tension, proper movement, transport, and a smoothing effect to the print ribbon with a gimbaled or pivotal support for accommodating support across the width of the print ribbon. Additionally drive controls and motor functions are provided for improved ribbon and media drive with enhanced overall automatic control.

More specifically, the invention comprises a print ribbon transport and drive system which helps to remove ribbon inconsistencies and variations. Ribbon variations are encountered due to the fineness of the print ribbon and heating that takes place at the thermal printer head. In order to remove the variations this invention utilizes a pair of rollers or other offset surfaces. The rollers specifically work the print ribbon in one direction and then the reverse direction. This reversal of direction and the working of the print ribbon irons the print ribbon in a manner so that wrinkles are diminished.

The invention further incorporates the concept of eliminating variations by working the print ribbon over a roller or another type of reverse surface. This working can be enhanced by variable spring loadings on the ribbon through leaf coil springs or other means supporting rollers or other working surfaces such as rods or plates across which the print ribbon moves.

The invention enhances the further handling of the print ribbon after and during the movement thereof through the print head process by means of another transport system. This second transport system after printing incorporates a roller or guide surface which can be gimbaled to accommodate variations across the width of the print ribbon. This gimbaled roller can be provided with any other type of surface so as to accommodate the movement of the print ribbon thereacross.

A further feature of this invention is the ability to adjust the placement of the gimbaled support and accommodate various sizes with regard to its overall lateral support of the print ribbon. This is accomplished by a screw means or other adjustment means that can move the center of support of the print ribbon gimbal or gimbaled roller laterally across the print ribbon both manually and/or automatically.

A further enhancement of this invention is the fact that it can accommodate variously sized and variable print ribbon width by having a motorized adjustment of the support of the print ribbon after it has been printed upon. This can be done by a motorized screw system such as a lead screw and/or ball screw with a motor and a sensing system that senses the edge regions of the print ribbon.

A further feature is the adjustment of the print head pressure by a motorized and automated movement of the print head against the platen.

The entire drive of the ribbon using the back (BEMF) of the drive motors can be remotely controlled for improved drive. Also the drive and transport can be automated for size, quality, variables in print, heat temperature and location, as well as other functions.

As a consequence, this invention is a significant step with regard to the transport of print ribbon, the ability to diminish print ribbon variations, inconsistencies in print quality, and the ability to make adjustments of variably sized print ribbons.

DESCRIPTION OF THE PREFERRED EMBODIMENTS

Figure 9:
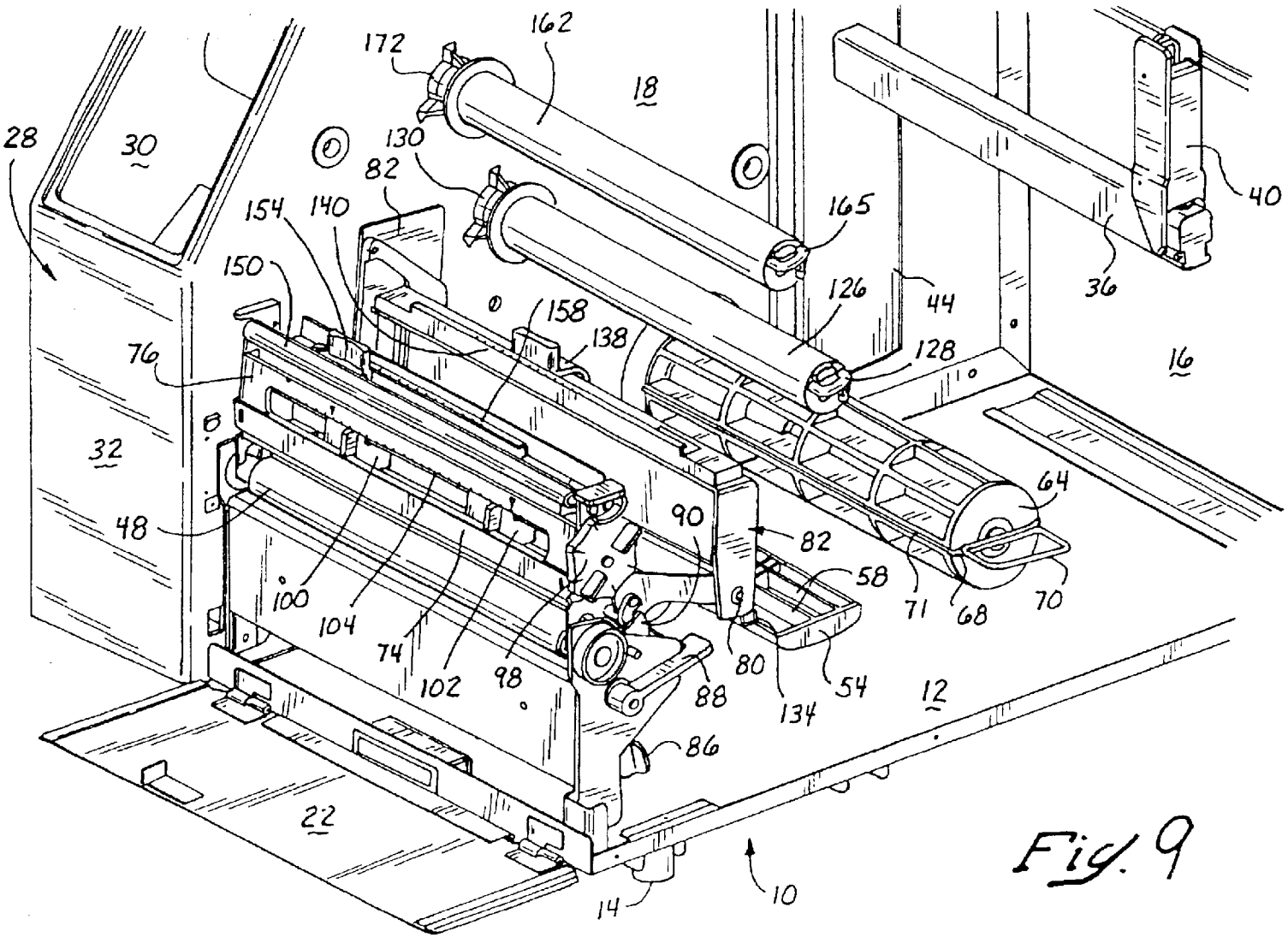
FIG. 9 shows a perspective alternative view of the transport system.
Figure 10:
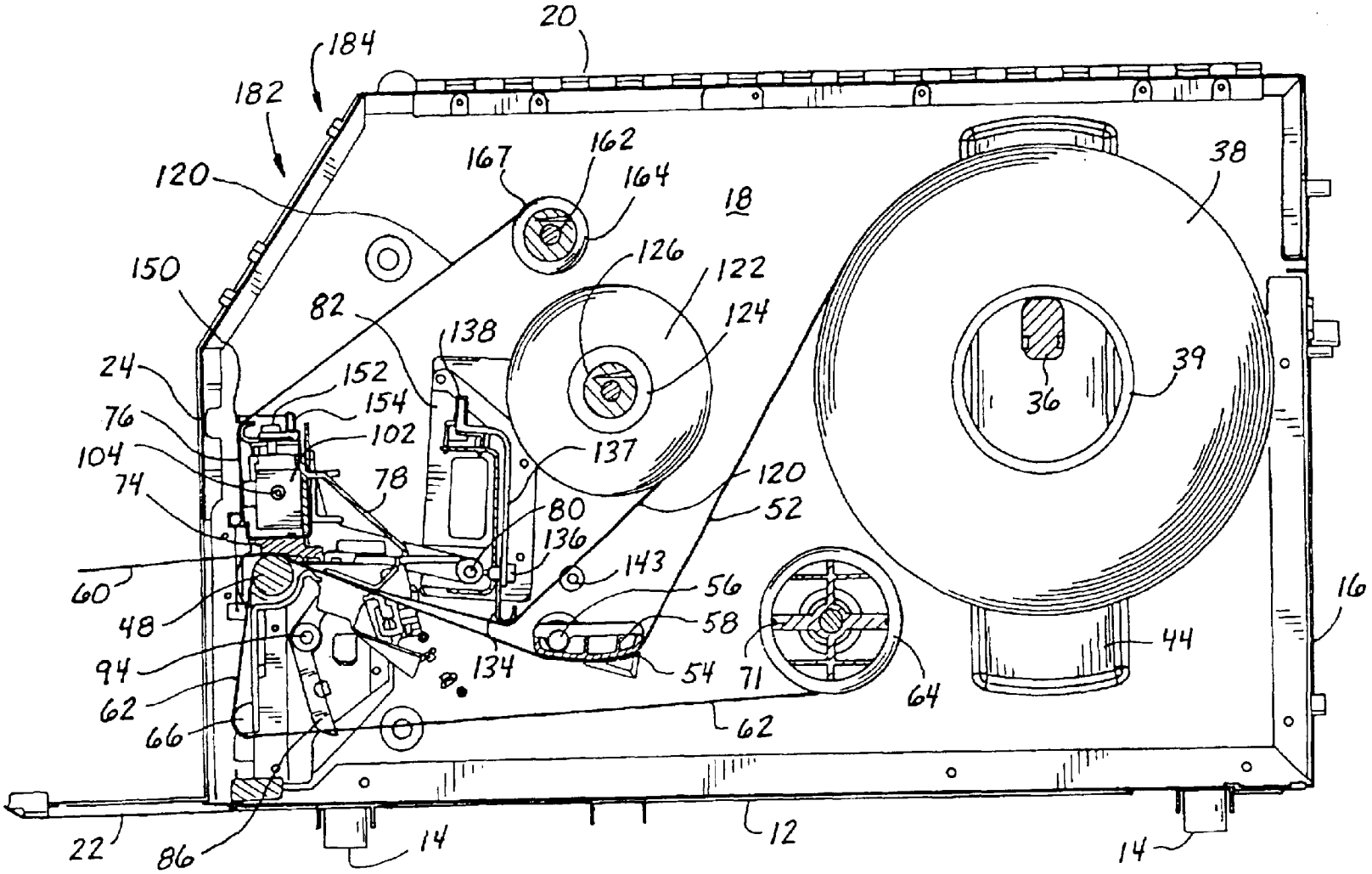
FIG. 10 shows a partially sectioned side elevation view of an alternative embodiment of the transport system of this invention.
Figure 11:
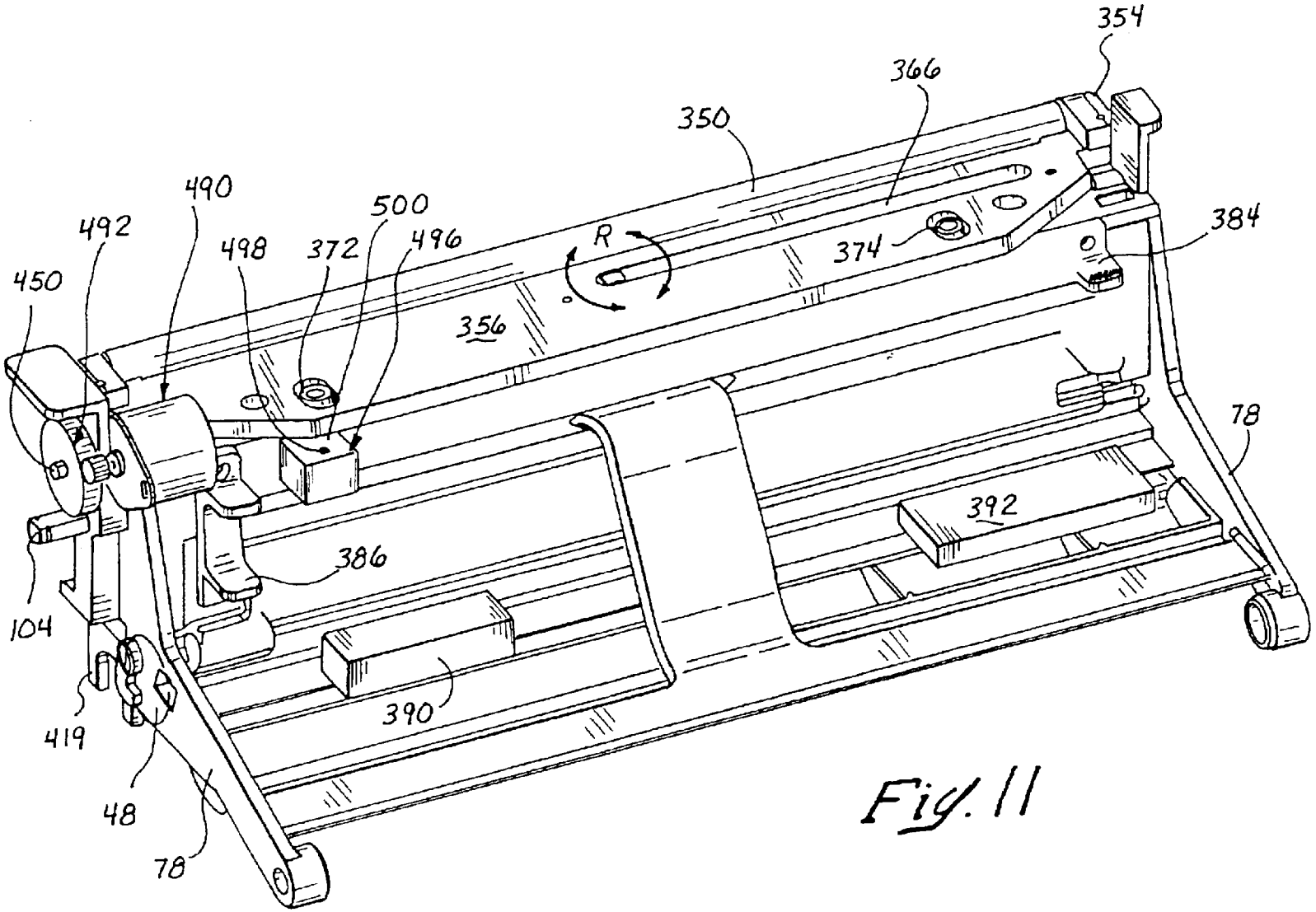
FIG. 11 shows a perspective view of the thermal print head and gimbal support and roller.

Looking more specifically at FIGS. 9 and 10, it can be seen that the thermal printer as an alternative embodiment of this invention is shown in a perspective and side elevation view. The perspective view of FIG. 9 does not have any print ribbon connected to the respective spindles nor any media on spools as in FIG. 10. FIG. 10 more aptly shows the path of the media and the print ribbon which shall be detailed hereinafter.

Looking at the apparatus of FIG. 9, it can be seen that a thermal printer 10 has been shown with a case constituting a base portion 12 having legs 14 upon which it stands. The base portion 12 forms the base for back wall 16 and cast drive support wall 18 that is in the form of a casting. The casting of wall 18 is specifically utilized because of the rigidity which is desired for the supports of the drive mechanism.

Figure 2:
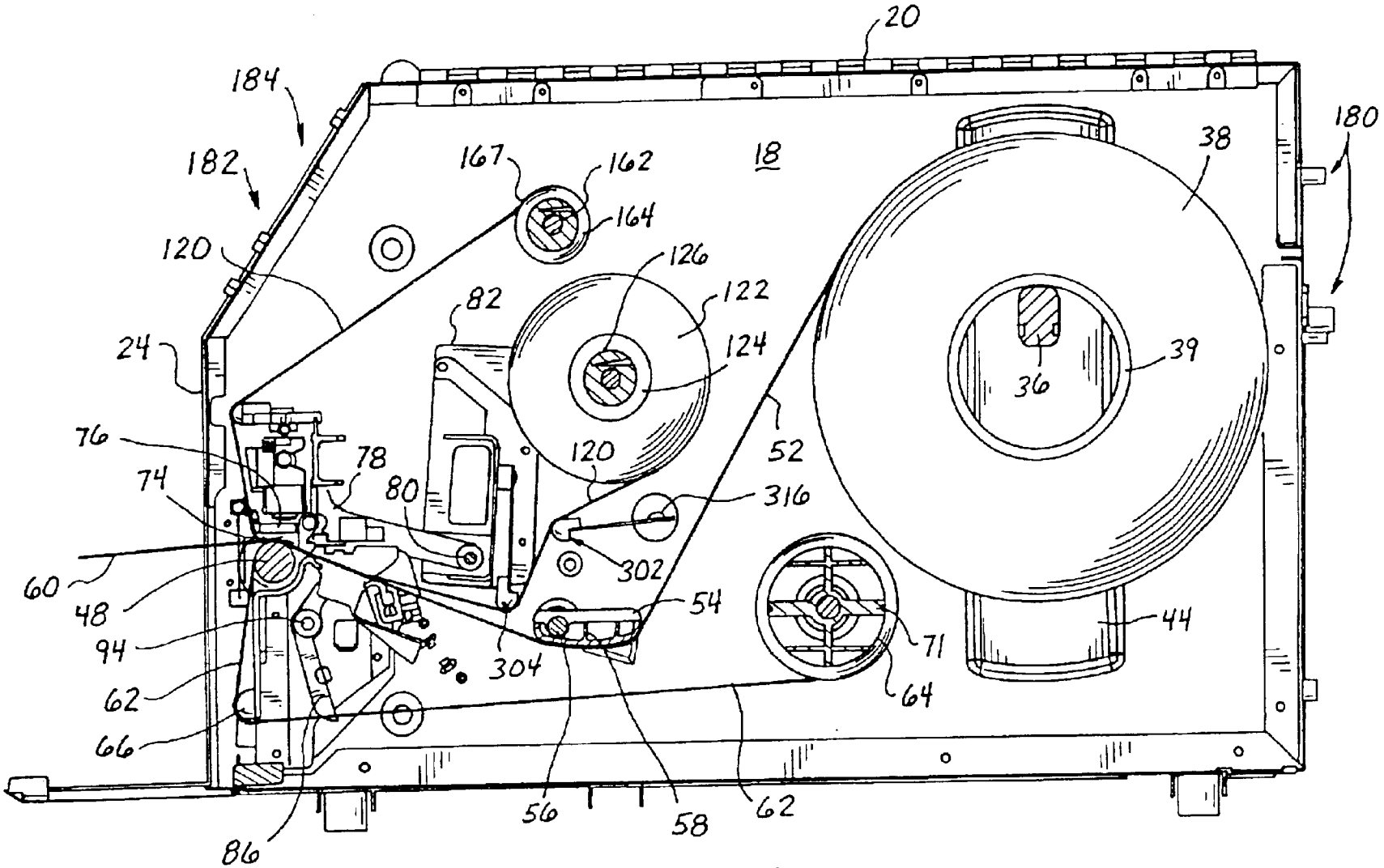
FIG. 2 is a partially sectioned side elevation view of the print ribbon path across the transport and support system as spools of the media and print ribbon itself move over the print head and then are rewound.
Figure 3:
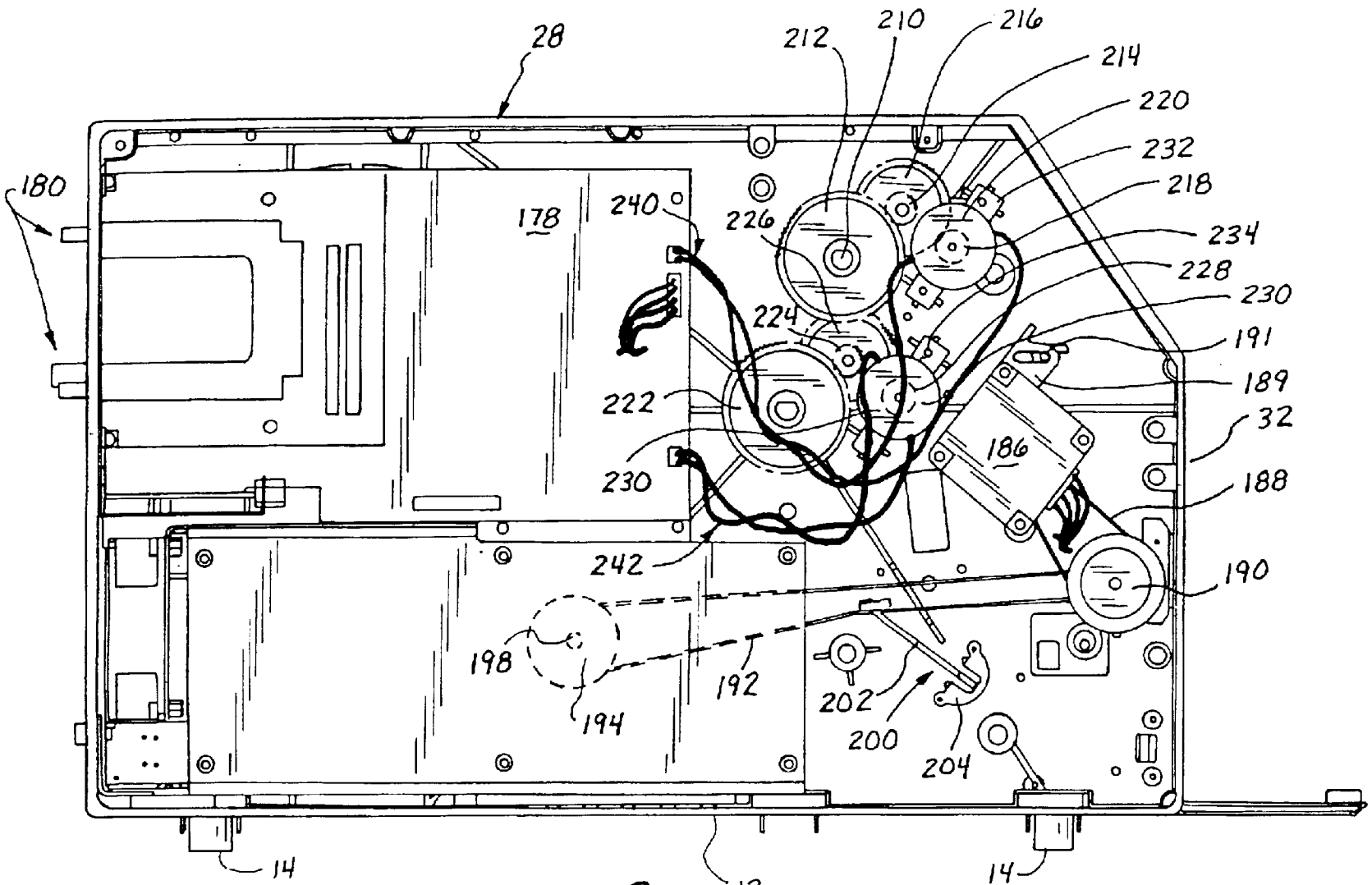
FIG. 3 shows a side elevation view of the drive system incorporating the media drive motor, D.C. motors for controlling the tension on the print ribbon as well as the gear train and electronic controls.
Figure 4:
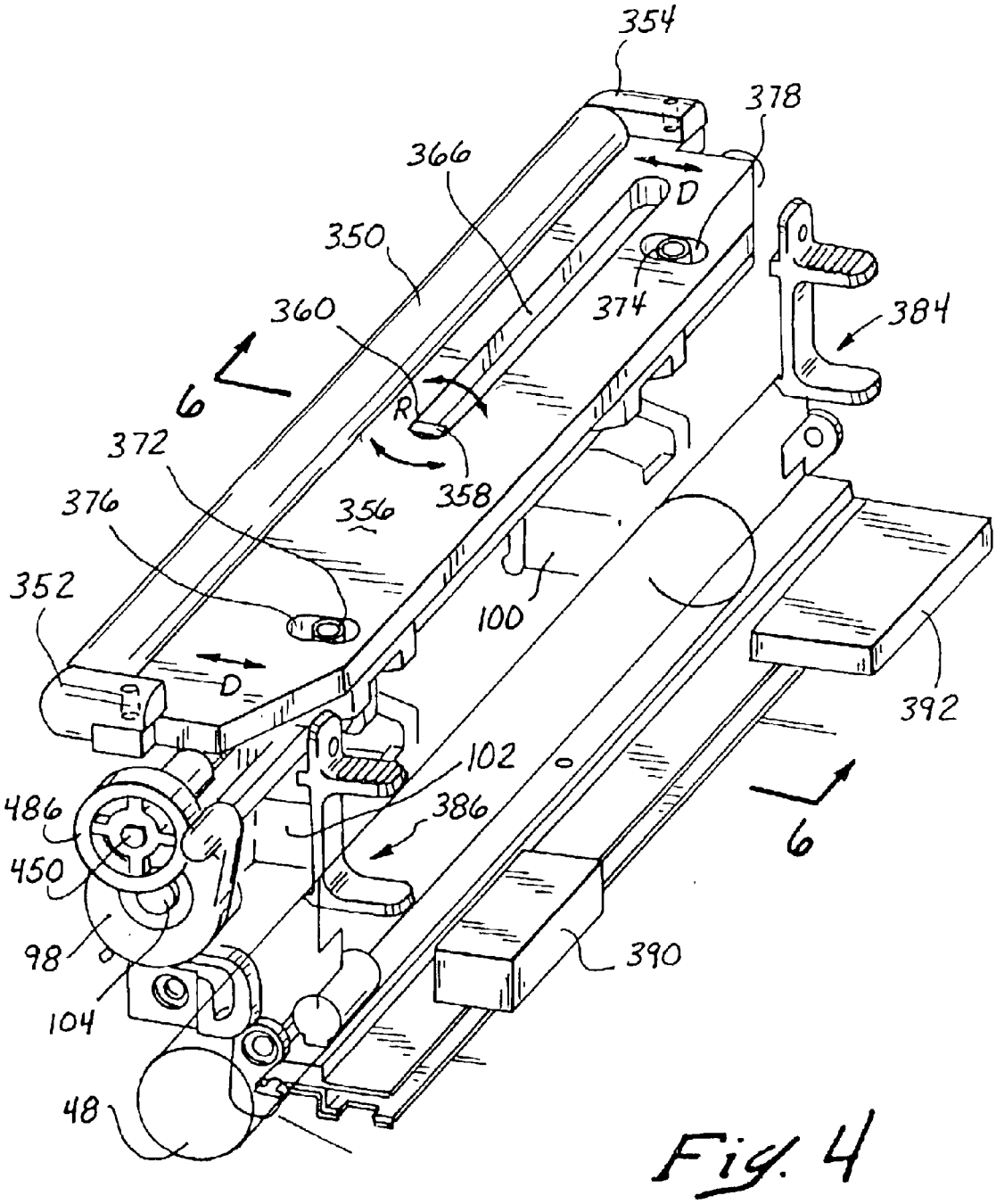
FIG. 4 shows a perspective view of the print head and platen with the transport for the print ribbon after it has moved through the printing station between the print head and the rotatable platen.

The casing is covered by a hinged lid that is not shown but wherein the hinges 20 attached to the lid are shown in FIG. 2. A frontal access door 22 and top door 24 are shown as part of the lid and covering components.

Behind the wall 18 that is formed by the casting is the control and mechanical drive for the thermal printer which are mounted therein. This is shown within a housing or casing 28 having an open portion 30 and front wall 32. The housing 28 can be of any suitable material so long as it covers and maintains the overall dust free environment and avoids contamination while at the same time protecting the gears and operators with respect to the gears.

In order to provide media to print on, a media support rod, bar or rack 36 has been provided to support a spool of media. The bar 36 is connected to the wall 18 in a rigid manner and is supported rigidly based upon the strength of the casting of the wall 18. In order to provide for media which is shown as a media roll or spool 38 on the bar 36, it is slipped over the bar. The roll or spool of media is supplied initially on a tube or cylinder 39. Afterwards a keeper 40 is placed in general alignment with the bar 36 and then moved vertically in order to lock the media roll 38 on the bar. The support of the media spool 38 is rigidified by a bossed portion 44 of the casting. The media can be a roll of paper, plastic, or tear off labels on an underlying sheet.

The media support rod 36 allows for the media to be transported by being pulled by and driven over a platen 48. The platen 48 can be a hard rigid elastomeric roller member which rotates and is driven by a drive mechanism within the casing 28. As the platen 48 rotates it pulls the media as can be seen in FIG. 2 in the form of a media strip 52 in a manner so that it is supported under tension with a pivotal foot 54.

The pivotal foot 54 is spring loaded by a coil spring on a rod 56 which allows for tensioning downwardly against the media strip 52 to keep it taut. The foot can be composed of any particular surface. In this particular case it has been shown as a convex elongated member. It has bracing ridges 58 therein in order to rigidify the foot 54 as it moves upwardly and downwardly for tensioning purposes around the axis of the pin or rod 56. This allows the media strip 52 to be held in a tightened or slightly stretched position as it passes thereunder. This is due to the spring load on the media strip 52 downwardly as it is paid off of the roll of media 38.

The media strip 52 passes toward the platen 48 and is pulled thereover by rotating the platen 48. The media strip 52 can be printed with labels. Dislodging or stripping of the labels from the media strip 52 can be provided. These labels can be seen as the end printed product 60 moving outwardly away from the platen 48 after printing. In order to retract the underlying portion of the media 62 after the labels 60 have been removed therefrom, the remaining media underlying the labels 60 is coiled around a spindle 64.

The underlying or base media 62 is initially wrapped around the spindle 64 so that it can be pulled from the platen area over a surface 66. In order to secure the underlying base media 62, a spring loaded clip 68 seated in grooves of the spindle 64 is provided. The clip 68 also has a handle 70 which can withdraw the tines of the spring loaded clip from the grooves of the spindle 64. This allows placement of the underlying base media 62 around the spindle. It is then secured by the tines 71 on either side of the spindle 64 within a groove of the spindle. Fundamentally the clip 68 is like a forked spring member having a handle 70 with tines 71 securing the media around the spindle 64.

In order to make an imprint upon the media 52, a thermal print head 74 is provided and is spring loaded against platen 48. The thermal head 74 has a number of heating elements that can be greater than six hundred dots per inch across the width. These dots provide the dot matrix printing by heating the print ribbon. The printing head is supported on a support 76 and extends backwardly on a bracket 78 attached to a pivotal member and pin 80. This allows the thermal head 74 to be lifted off on the pivoting bracket as it pivots around the pivotal support 80. Pivotal support 80 is in turn connected to a wall bracket of wall 18 in the form of bracket 82.

The thermal head 74 is locked in place by means of a latch lever 86 connected to a tab or handle 88 having a latch hook 90 that overlies a portion of the bracket 78 in order to hold it in place. The lever 86 with the latch hook 90 can be pivoted backwardly around a pivot 94 to allow upward movement of the head 74. The head 74 is cammed for finite movement against the platen 48 by means of a lever handle 87 connected to a cam that drives the head into position over the platen.

Figure 12:
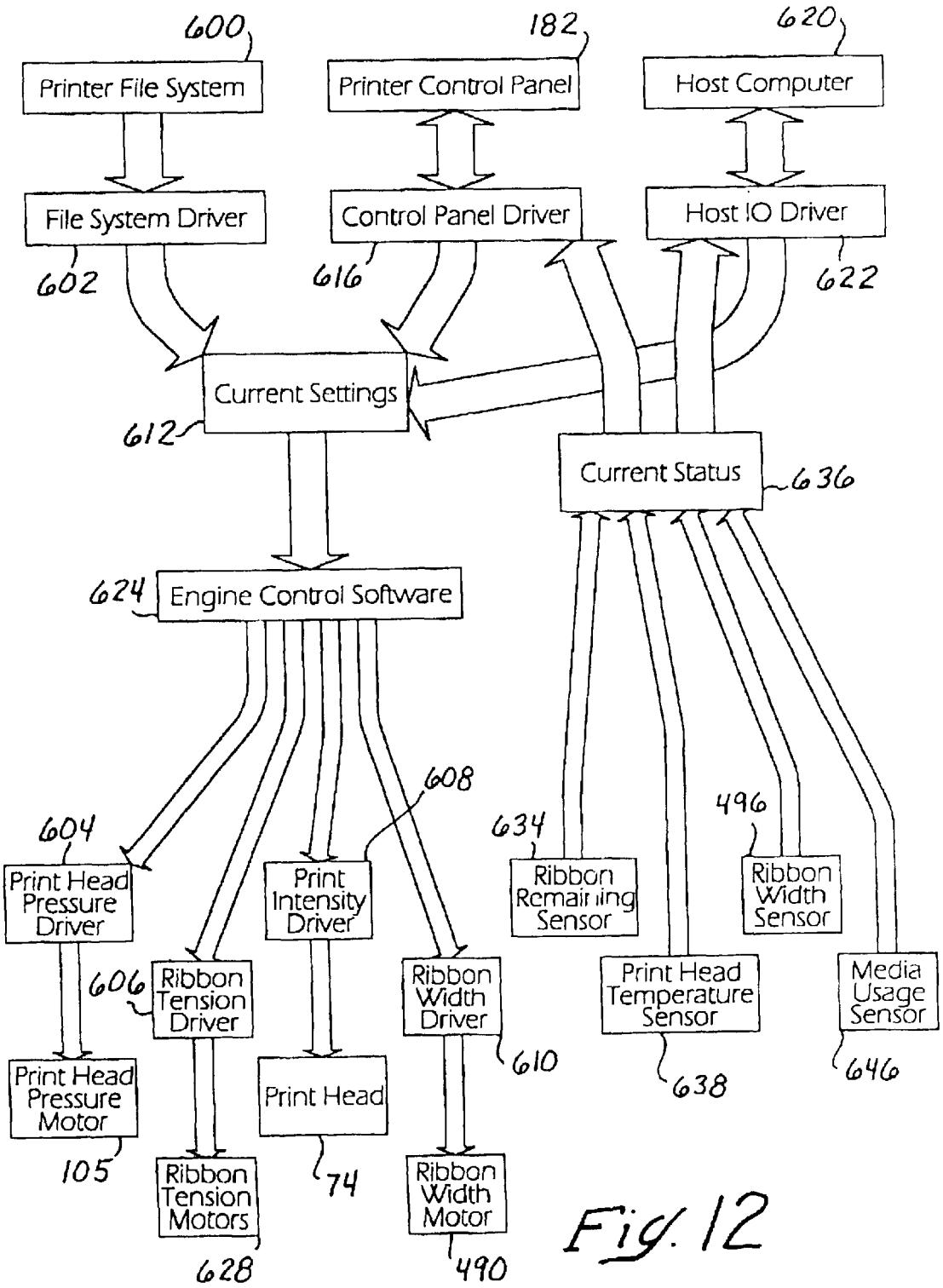
FIG. 12 shows a block flow and logic diagram for the automation of the printer functions.

The thermal head 74, as previously mentioned has a number of heating elements arrayed along its longitudinal length. The heating elements can number upwards of six hundred dots or more per inch. The heating elements of print head 74 are sensed as to their relative temperature by an internal print head temperature sensor 638 shown in FIG. 12 to control the heat on the various heating elements. The heat of the heating elements when sensed by sensor 638 is then processed to provide the intensity or degree of heat to the print intensity driver 608.

The engagement of the thermal head 74 against the platen 48 can be controlled at the bite or intersection thereof by turning a knob 98 connected to two respective blocks 100 and 102 having spring blocks 401 which are forced against the thermal head 74. The head 74 floats under pressure of springs which provide the head pressure which can be adjusted as set forth. This head pressure can be automatically adjusted by the system set forth in FIG. 12 and the related description hereinafter.

The two respective blocks 100 and 102 have cam members therein and are driven by a shaft 104 connected to the knob 98 in order to drive the blocks 100 and 102 into tighter engagement to push the print head 74 or loosen it against the platen 48 under the spring pressure. The knob can be substituted by a motor which turns the shaft 104. The motor can be remotely controlled by logic from controller 178 or from a host 620 for accurate positioning of the head 74 against the platen 48.

The controller can be supplemented with a control panel 182 and a control panel driver 616, printer file system 600, file system driver 602 with current settings 612 connected to the engine control software 624.

The media spool 38 provides a strip 52 over the platen 48 and under the print head 74. This is in association with a print ribbon, or film 120 delivered from a print ribbon roll or spool 122. The print ribbon roll or spool 122 is supported on a tube or cylinder such as a cardboard tube 124 and in turn is emplaced on a spindle 126. The spindle 126 receives the spool of print ribbon and is held in place by a clip 128 which expands against the tube 124 of the roll 122 and in particularly cardboard tube 124 upon which the print ribbon is rolled. The clip can be substituted by any other method of retention.

The print ribbon strip 120 can vary in width such as by a four, six or eight inch width. The media strip 52 can also be of those various size widths.

The spindle 126 is driven by a D.C. motor connected to the spindle as will be expanded upon hereinafter and is held to a wall by a journaled bracket 130. The print ribbon strip 120 passes under an elongated semi-circular plate 134 which has a rounded configuration in the alternative embodiments of this invention shown in FIGS. 9 and 10.

As seen in FIGS. 9 and 10 the plate 134 is fundamentally a pivotal gimbaled plate which can move around a pin 136 supported on a depending arm 137 as connected to a pivotal handle 138. The handle 138 is connected to the top of the bracket 82. This moves the pivot point of the gimbal plate 134 into various locations so that the print ribbon 120 passing thereover is supported across its width around a pivotal point established by pin 136. In effect, the pivotal handle 138 connected to the pin 136 is received in a slot and allows the gimbal plate 134 to pivot around the axis thereof as the print ribbon 120 in its full width passes over the gimbal plate 134.

The gimbal plate 134 can be substituted for, or supplemented with a roller over which the print ribbon passes. Also, a pair of rollers or curved surfaces on the front and back surface over which the print ribbon strip 120 passes can be utilized as in the embodiments of FIGS. 1 through 8 and 11. This helps to eliminate variations of the print ribbon as it feeds off of the spool 122. This embodiment as shown in FIGS. 1 through 8 and 11 will be detailed hereinafter.

The adjustment of the gimbal pin 136 for the gimbal element 134 with the handle 138 can be made along a given path and indexed as can be seen with index scale or marks 140. This is done by laterally moving the pivot pin 136 to a particular point for maintaining balance of the width of the print ribbon moving thereover. Furthermore, the adjustment scale or index 140 by moving the handle 138 can accommodate variously sized widths such as four, six and eight inches of print ribbon strips 120. Thus it has a dual function of maintaining the proper respective tension across the width of the print ribbon 120 as well as providing for adjustment of variously sized print ribbon from the spool 122.

The print ribbon 120 as it moves across the gimbal is then introduced and brought into contact with the media strip 52 between the print head 74 and the platen 48. The print head 74 is electrically driven for heating purposes by drivers 608 that can be included in the print head or extrinsic thereto. These drivers 608 create a degree of heated resistances for imparting selective dots of the material on the print ribbon strip 120 to the underlying media strip 52. Labels, such as labels 60 are then stripped off and allowed to be fed outwardly while the remaining portion of the media strip shown as media strip 52 is wound around the spindle 64. Spindle 64 is driven by a belt drive on the other side of wall 18 as will be expanded upon hereinafter.

After the print ribbon 120 has passed between the print head 74 and platen 48, it moves upwardly over the bracket 76 into contact with another gimbal bar 150. This gimbal bar 150 is controlled in its lateral movement in the direction of the print ribbon by means of a pin 152 attached to a handle 154. The bar 150 can be adjusted so it can accommodate the lateral movement of the print ribbon 120 web passing thereover. The pin 152 can be centered for proper support of the print ribbon 120 web by a motor driver controlled through the engine control software 624. Alternative drive systems can be analogous to the ribbon width drive 610 and ribbon width motor 490 set forth hereinafter.

This handle adjustment 154 can be seen with an index 158 that allows for the various widths of print ribbon 120 as well as adjustment of the respective ends of the bar 150. This accommodates the movement of the print ribbon strip 120. Thus, a degree of tension and consistency of the print ribbon is maintained over the gimbal bar 150 as it is wound on a take-up roller or spindle 162. This function as previously stated can be motorized and controlled automatically by the engine control software 624 and attendant current settings 612.

The width of the ribbon 120 can also be accommodated by indexing of the gimbal bar 150 from the edge of the ribbon by a double screw turned manually or automatically by a shaft. This is further detailed in FIGS. 7, 8, 9, 10, and 11 as described hereinafter.

The handle 154 and orientation of the gimbal bar can be substituted with a motor drive attached to a lead screw to move the center point or pin 152 from side to side as seen in the other embodiment. This motor shown in FIG. 11 and the lead screw is further detailed in FIGS. 7 and 8. This motor movement for placement of the pin 152 can be effected by remote logic from a host 620, and/or the controller 178, and/or the control panel 182. This placement can also be monitored as in FIG. 11 by a sensor for dynamic movement and stabilization of the ribbon 120 by the bar 150 to compensate for width and other variations of the print ribbon.

The take-up roller or spindle 162 can be seen with a tube of cardboard 164 upon which the print ribbon 120 is wound in the rewind condition. The print ribbon 120 can be emplaced in any manner around the spindle 162 and secured by a clip 165 holding the cardboard tube 164 or any other retention means. As the take-up spindle 162 is rotated it develops a wound spool of used print ribbon 120 in the form of a spool 167 that is shown developing as winding is taking place.

As an aside, it is generally customary to remove the cardboard tube from the feed roll such as cardboard tube 124 and place it on the take-up spindle 162 after the roll 122 has has been fully expended. This allows for continuity and usage of the cardboard tube in developing the take-up spool 167.

The spindle 162 is supported on a journaled bracket 172 connected to the wall 18 to allow rotational movement by means of a D.C. motor as will be expanded upon hereinafter.

Looking more specifically at the opposite side of the wall 18 within the cabinet 28, it can be seen that a controller card 178 having the controls as well as the power supply and other means for controlling the thermal printer has been shown. This controller card 178 is connected by various terminals such as terminal areas 180. Terminal areas 180 connect the controller card 178 to a host such as a host computer 620 or other control means driving and inputing the information to the memory and processor of the controller card 178. These can comprise other control portions including a printer file system 600, the file system driver 602, all in communication with the printer control panel 182; control panel driver 616 that is connected to current settings 612 and the engine control software 624.

The thermal printer can also utilize a control system with a pre-programmed printing memory established through an input or control panel 182. This has been shown as input or control panel 182 having on/off and other programmable features which are programmable by buttons or switches 184. In most cases the thermal printer is connected and controlled for sophisticated alpha numeric output and bar codes to the host computer 620 or controller 178. It should be understood that various controls and drive systems including those from the host 620 can be utilized for the print and media drive motors of this invention as well as the input to the drivers 608 of the thermal head 74 to provide print orientation as well as variations in heat output.

Looking more particularly at the ribbon and media drive system of the thermal printer 10, it can be seen that a two phased stepper motor 186, which can be of any other phase known to one skilled in the art has been shown. Stepper motor 186 controls and drives the platen 48 by means of a belt 188. The belt 188 can be adjusted by a tensioning means 189 which is adjusted by means of a screw setting 191 in a slot. The belt 188 is connected to a pulley or sheave drive 190. The sheave 190 drive shaft is connected to a second belt 192 which is in turn connected to a sheave or pulley 194 that connects to the underlying media strip 62 take-up spindle or roller 64. This can be accomplished by a shaft 198 passing through the sheave or pulley 194 interconnecting the roller 64 at the shaft which it is journaled on. The platen stepper motor 186, control and associated take up of expanded media is controlled by the engine control software 624 and the related current settings 612 as dictated by the controller 178, panel 182 and host 620.

In order to hold the belt 192 in tension, a tensioner 200 is shown comprising a tensioner arm 202 connected to or molded with a bracket 204 which is in turn mounted to the wall 18 by screws or other fastener means. The tensioner 200 is biased for upward pressure against the belt 192, but can be used to tension it in either direction (i.e. upwardly or downwardly).

The respective shaft to the take-up spindle 162 or spool is shown as shaft 210. Shaft 210 passes through the wall 18 and is connected to the take-up spindle 162 on one end and to a gear 212 on the other end. Gear 212 is connected to a pinion 214 which is in turn connected to a gear 216 driven by a gear 218 of a D.C. motor 220.

The supply spool spindle 126 on which the print ribbon spool 122 is mounted has a common shaft with a gear 222 that is shown with the common shaft passing through to the spindle. This gear 222 interfaces with a pinion 224 that is connected to a gear 226. Gear 226 is in turn connected to a gear 228 that is connected to a D.C. motor 230.

Both motors 220 and 230 are mounted by means of brackets respectively 232 and 234. These respective brackets allow adjustment of the D.C. motors 220 and 230. The motors 220 and 230 can be brush motors or brushless motors with logic to provide analogous functions to a brush motor.

D.C. motor 220 is connected to the controller and driver 178 by means of two lines 240 while D.C. motor 230 is connected thereto by lines 242. These two respective lines 240 and 242 allow for the driving of the motors on an incremental basis. They also receive feed back therefrom as to the back EMF (BEMF) established when the motors are moving. Both motors 220 and 230 cooperate to provide ribbon tension and can collectively be referred to in their logic functions as the ribbon tension motors 628 as driven by the controller 178 and ribbon tension motor's drive 606.

This BEMF is significant and substantial in the control of the motors 220 and 230. The control of the motors places tension on the print ribbon 120 as it is taken up on spindle 162 and paid out from spindle 126. Thus as spools 122 and 167 are respectively paid out and developed the torque on the spools and attendant tension of the print ribbon 120 is compensated. This allows for the desired tension and controlled movement of the print ribbon 120 as the spools 122 and 167 are respectively decreasing and increasing in their radius, and attendant mass, and relative radial velocity.

The respective inputs to the coils of the motors have been shown. These coils are in turn connected to the controller box 178. This has been previously set forth as providing the controls as well as the power and other functions necessary to run the thermal printer based upon the information input at terminals 180.

The supply spool motor 230 is connected to the print ribbon supply spindle 126 which has the spool 122 thereon. This connection is through gears 222 through 228. This gear drive with the motor 230 is used to create desired tension on the ribbon 120 in the area between the supply spool 122 and the platen 48.

Control of motors 220 and 230 for proper tension of print ribbon is through the controller 178 utilizing the engine control software 624 noting the Back EMF (BEMF) of the motors and adjusting the motor torque based upon inertia, required torque, and velocity. This is done through the engine control software 624 with the ribbon tension motors (220–230) collectively 628 and driver 606. The ribbon 120 remaining can be sensed by calculating the supply spool 126 speed in reference to the take up spool 162 speed. This is done in conjunction with calculating the supply spool 126 radius. From this a ribbon remaining value is derived as the ribbon remaining sensor 634 in the controller 178. In the alternative a photo-optic, laser or analog to digital sensor and read out can be provided for the ribbon remaining sensor 634 function.

The media usage is also calculated by means of determining media spool 38 size. This can be through the motor feedback and radial velocity of motor 186, various means such as photo-optic sensing, mechanical sensing, limit switches and other sensors which are referred to as the media usage sensor 646.

Figure 14:
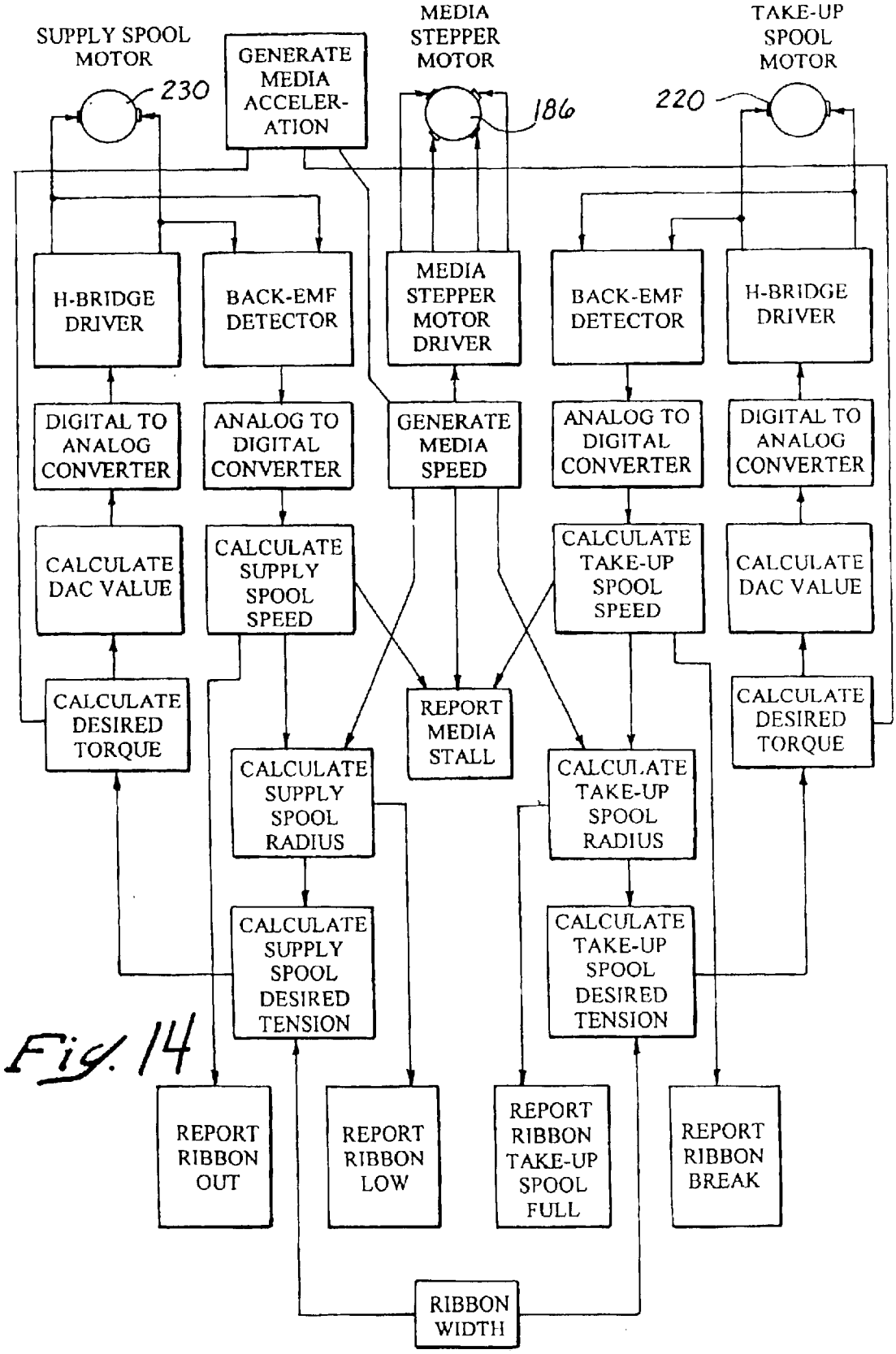
FIG. 14 shows the logic and system for controlling the drive motors and operating the thermal printer.

All of the foregoing motor functions and calculations can be seen in their systematic and logic aspects in FIG. 14 which sets forth the operating aspects of the system.

Figure 1:
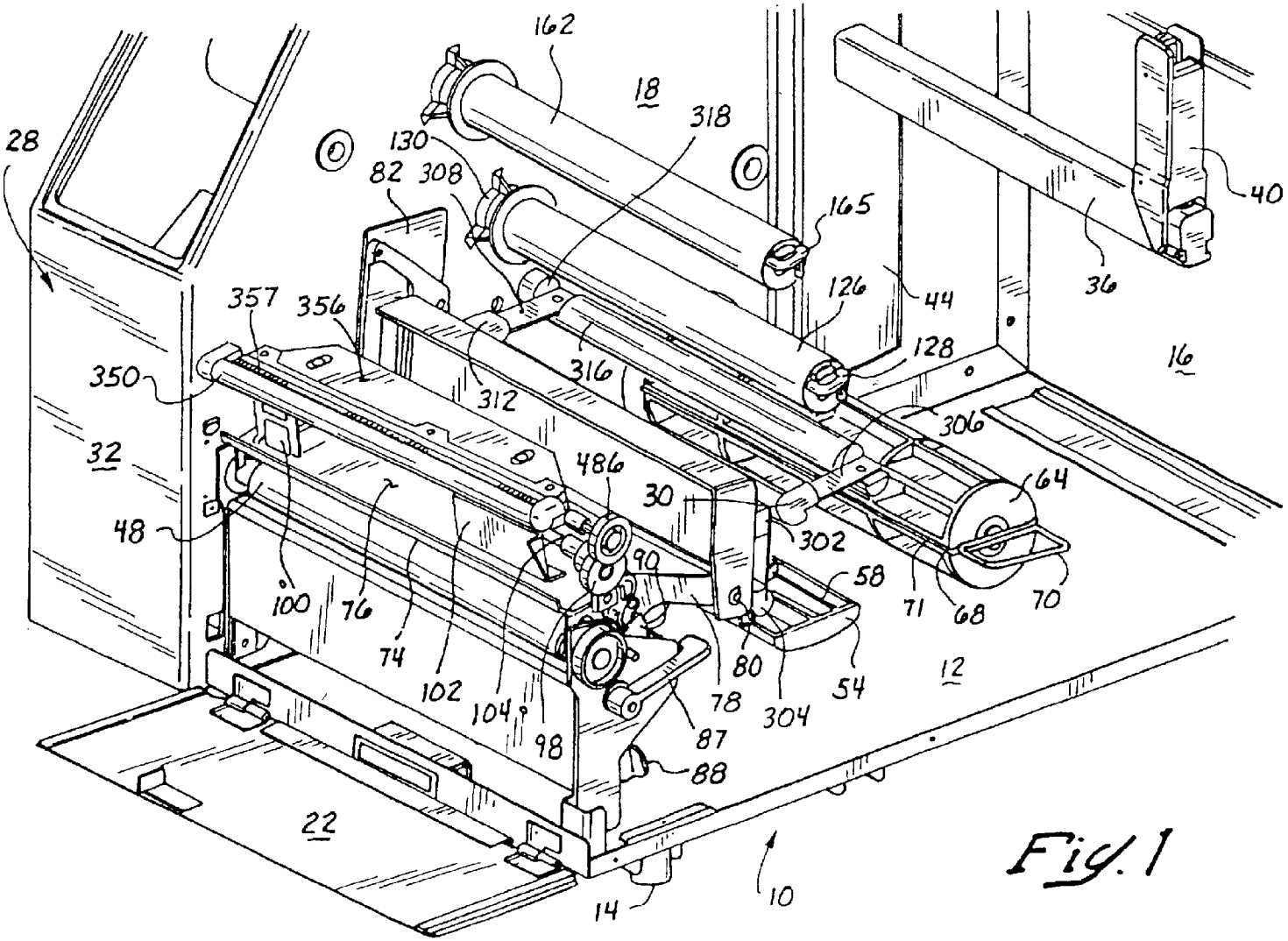
FIG. 1 shows a perspective view of the drive and take-up spools of this invention incorporated with a thermal printer head and transport system showing the rollers and gimbaled support.

Looking more particularly at FIGS. 1 and 2, it can be seen that there are substantially analogous components as far as the drive system is concerned. Also, FIG. 3 which is analogous to both embodiments shows the drive system.

FIGS. 1 through 8 and 11 are specifically directed to a transport system having rollers for removing striations, variations, and general print ribbon inconsistencies. However, as far as the drive is concerned much of the drive remains the same.

Looking more specifically at FIGS. 1 and 2, it can be seen that an initial pair of rollers 302 and 304 are shown over which the ribbon 120 passes. A single roller can also be used such as roller 302 or 304. The use of a single roller such as roller 304 can be enhanced by a surface, rod or guide plate being substituted for one of the rollers, in this case roller 302.

The rollers, 302 and 304 or guide surfaces act as self aligning guides to uniformly distribute tension over the web. In effect the self aligning guide functions both as an ironer and guide to help eliminate the various printing problems of stretching, striations crimping, and other misalignments and inconsistencies.

Roller 302 is supported on two leaf spring members 306 and 308. The leaf springs can be substituted by other resilient members including coil springs or elastomeric cushions or shock mounts. These two spring members 306 and 308 are held in bearing housings 310 and 312. These bearing housings or journals allow the roller 302 to roll therein and can be made of a sintered bronze, plastic, ball, or roller bearing type of bearing for allowing the roller, 302 to freely rotate therein. This relationship can be seen more clearly in FIG. 5.

The springs 306 and 308 are connected to a support 316 which can be varied. The support 316 in the form of a rod or arm can turn around an axis 318 for appropriate changes of the leaf spring orientation and spring constant of the leaf springs 306 and 308. In this manner, the roller 302 can apply greater or lesser pressure against the print ribbon 120 rolling thereover.

It should be understood that any type of roller 302 can be utilized in order to apply the force against the ribbon 120 as it moves thereover. Also, the movement of the ribbon 120 can be over the roller or under the roller initially and then reversed through the next roller, or over a guide plate or rod substituted for one or the other.

Figure 5:
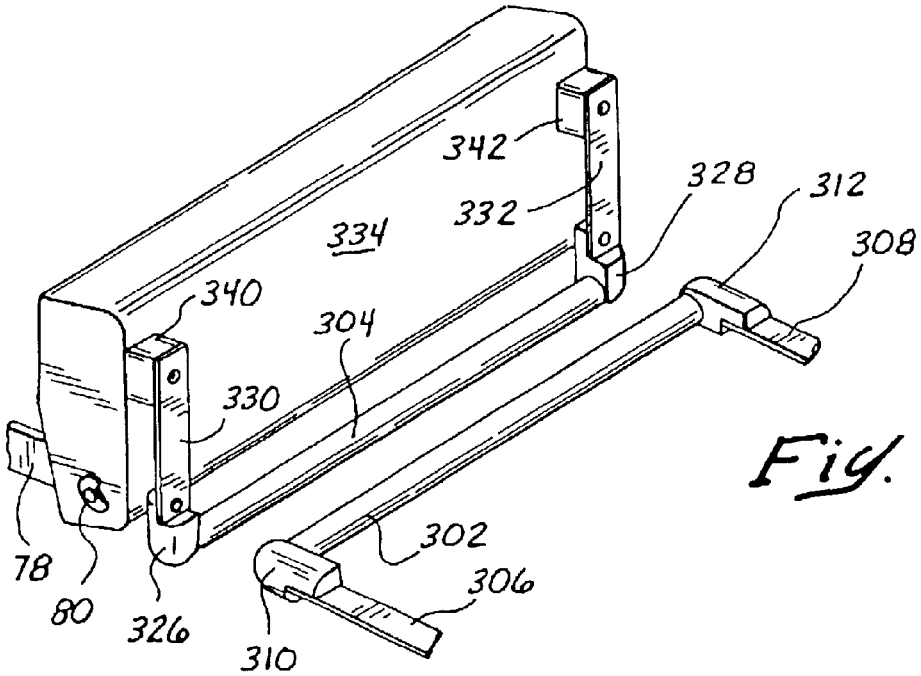
FIG. 5 shows a perspective view of the spring loaded transport system with the rollers to diminish print ribbon variations.
Figure 6:
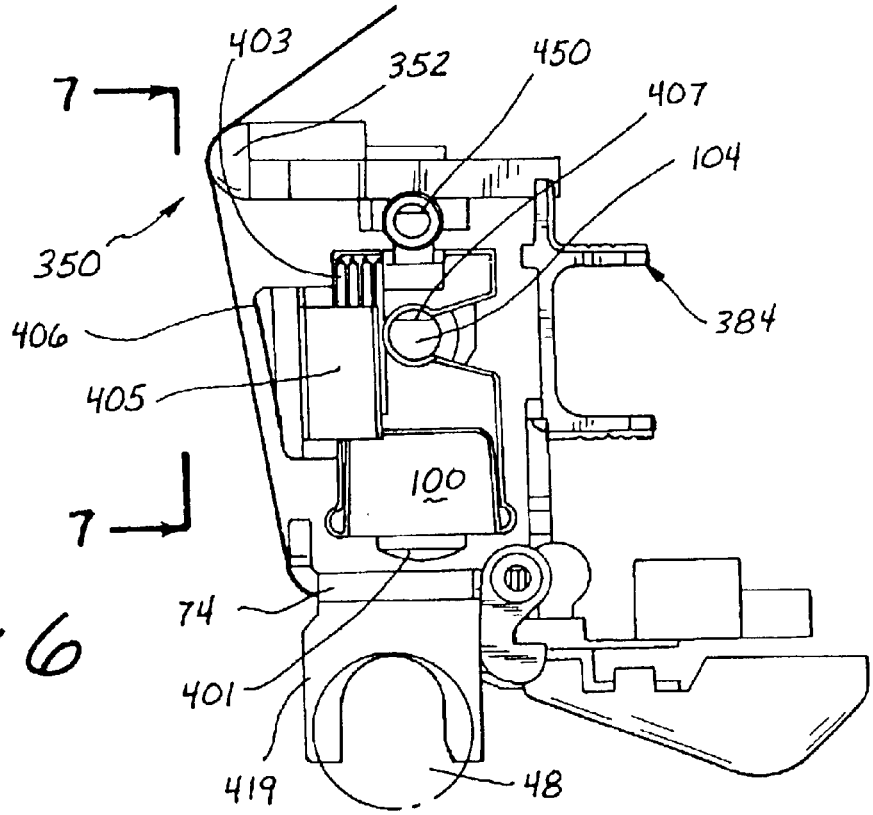
FIG. 6 shows a sectional view in the direction of lines 6—6 of FIG. 4.

Looking more particularly at FIG. 5 and the attendant showing of FIG. 2, it can be seen that the second roller 304 has been shown. This second roller 304 is particularly used in this case for the print ribbon 120 to pass under. Roller 304 is connected in like manner as roller 302 to a pair of journals or bearings 326 and 328. Here again, these journals or bearings 326 and 328 can be a sintered bronze or any other type of material which can be easily provided with a bearing surface for the roller 304.

In order to support the bearings 326 and 328 which can be ball bearings, bushings, or any other type of support for the roller 304, a pair of leaf spring like members 330 and 332 are utilized. These spring like members 330 and 332 are anchored to a plate member 334 which is in turn connected to a wall bracket 82. The springs 330 and 332 are connected by pins, or in any other suitable manner respectively to the roller 304 housings, bearings or journals 326 and 328. Also, springs 330 and 332 can have their spring constants changed by a variable mounting in the form of mounting 340 and 342. These can be hinge mountings, coil springs, or elastomeric supports to apply greater or lesser force against the print ribbon 120 as it passes over the roller 304. These can also be self aligning guides as gimbaled in the manner set forth herein.

The foregoing roller transport incorporating the rollers 302 and 304 respectively allow the passage of the print ribbon 120 over roller 302 and under roller 304. However, this orientation can be reversed depending upon the desired pull or feed technique. Another roller can be applied after roller 304 for feeding, direction or ironing appropriately to the platen 48. Suffice it to say, the rollers 302 and 304 desirably tension the print ribbon 120 between them so as to remove striations, variations, valleys, and inconsistencies across the face of the print ribbon 120 as it moves thereover and help to iron the ribbon. These rollers 302 and 304 also serve a normalizing function to the plastic underlying material of the print ribbon 120 during the working and ironing process provided by the rollers.

As the print ribbon 120 after printing emerges from the point between the print head 74 and the platen 48, there are certain striations, inconsistencies, and wave forms that can develop and be propagated back into the print head. If these wave forms are propagated into the print head so that inconsistencies and variances across the print ribbon exist, improper printing takes place. In order to avoid this, the invention specifically has an innovative gimbaled roller 350, that acts as a self aligning guide.

The gimbaled roller 350 is supported in a set of bearing housings, journals, or bushings 352 and 354. These bearing housings are secured by means of screws or other common fastenings to a gimbal plate 356. Attached to the gimbal plate is a plurality of static removal brushes attached to a plate 357. The static removal brushes tend to trail on the print ribbon 120 as it moves over the roller 350 so as to allow for dissipation of static electricity as the print ribbon 120 is being taken up on the take-up spindle 162 developing a spool 167 of spent ribbon.

The roller or self aligning guide 350 turns within the bearing housings 352 and 354 on a free basis and can be journaled into bronze sintered metal or other types of bearing surfaces including ball bearings to allow the roller 350 to freely rotate. The roller 350 is supported on the gimbal plate 356 to allow for movement and self alignment dependent upon the particular orientation of the print ribbon passing thereover. Fundamentally the roller 350 on the gimbal plate compensates for variances across the width of the ribbon as to striations, waves and inconsistencies across the width and length.

In order to provide movement of the gimbal plate, a central pivot pin 358 is provided. Movement of the plate 356 and roller 350 can effect adjustment for various widths of print ribbon 120 so that the central support is centered for self aligning support. Central pivot pin 358 is a semi-circular sectioned pin or screw member so that the gimbal plate 356 turns on an edge 360 of the pin 358. The gimbal plate 356 rotates around the pin 358 in either direction of arrow R. This provides for the self aligning support across the web of ribbon 120.

Arrows D show the movement of the gimbal plate 356 at either end as they move backwardly and forwardly to compensate for the printer ribbon 120. The movement of the gimbal plate 356 can be adjusted by moving the pin 358 along a slot 366 so that the center reaction of the gimbal plate 356 moves in either direction to accommodate for variances in the print ribbon. The pin 358 can be of any cross-section including triangular or knife like to provide an edge upon which the gimbal plate 356 can rotate.

In order to accommodate, serve, and stabilize the gimbal plate 356 more effectively, a pair of sleeves 372 and 374 are provided within slots respectively 376 and 378. These slots 376 and 378 are provided to allow the movement of the gimbal plate 356 and are capped by means of screws or nuts thereover, the heads of which are removed.

The gimbal plate 356 can be adjusted as to its pin 358 by an automatic drive such as a stepper motor controlled by settings in current settings 612 and the engine control software 624. An appropriately oriented optical or limit switch sensor based upon control input can provide feed back to the engine control software 624 through current status 636.

In order to hold the print head and allow for removal, a pair of plastic handles 384 and 386 are shown having tabbed grips for holding the print head and allowing them to be squeezed for drawing the print head backwardly.

To electrically drive the print head 74, as to its heat and density of print as well as the other functions from the host 620 or controller 178 having the processor, a pair of terminal block connections 390 and 392 are utilized. Thus, data and electrical input can be applied appropriately through the terminal blocks 390 and 392. This includes electrical input for movement and to drive the respective heating elements of the head 74 to provide the dot printing functions.

For purposes of adjusting the pressure on the print head 74 against the platen, a wheel 98 that can be hand driven or motor driven is connected to a shaft similar to shaft 104. A motor 105 is shown connected to shaft 104 with connections to a print head motor pressure driver 604. Shaft 104 passes through a pair of blocks similar to blocks 100 and 102. These blocks 100 and 102 specifically have a cam therein and serve to drive upwardly and downwardly against the surface of the thermal head 74 as its rests on the platen 48. The thermal head 74 is provided with a spring bias so that it floats on its spring support against the platen 48. This can be seen in FIG. 6 wherein block 100 with a spring plate 401 is connected to a spring internally within the blocks 100 and 102. This spring plate presses downwardly against the print head 74. Again, this is controlled by shaft 104 driven when automated by print head pressure motor 105 electrically driven by driver 604.

The blocks 100 and 102 can be mounted by a series of tabbed or ridged elements 403 to which a clamp 405 holding them in place is shown. The clamp 405 has a pointer 406 to show the approximate position of the blocks 100 or 102.

The block 100 is shown with the shaft 104 passing therethrough and serves through the cam surface 409 to drive the block and spring plate 401 upwardly or downwardly against the print head 74 so that it engages the platen 48. Thus, as the shaft 104 is rotated, it cams the block 100 into a tightened or loosened position with regard to the print head 74 in its floating spring supported relationship. This movement and camming is also true for block 102.

In order to position the print head 74 in overlying relationship to the shaft of the platen 48, a U shaped bracket 419 can be seen. It should be understood that as the blocks 100 and 102 move upwardly and downwardly against the print head 74, they should be in relatively even forced relationship to press the print head 74 downwardly or relieve spring pressure in a uniform manner across the width of the print ribbon 120. For instance, if the print ribbon 120 is a four, six, or eight inch ribbon, the respective blocks 100 and 102 should be relatively spaced to provide spring pressure of the print head 74 against the ribbon uniformly against the platen 48.

Looking more specifically at FIGS. 6, 7, 8, and 11, it can be seen that the gimbal plate 350 has a lead screw 450 thereunder. The lead screw 450 incorporates a series of threads 452 that have twice the distance in pitch between them as threads 454 on the same screw. The threads 452 and threads 454 cause any threaded nut device or matching surface thereon to move respectively such that travel along threads 452 is twice as great as along threads 454.

Figure 7:
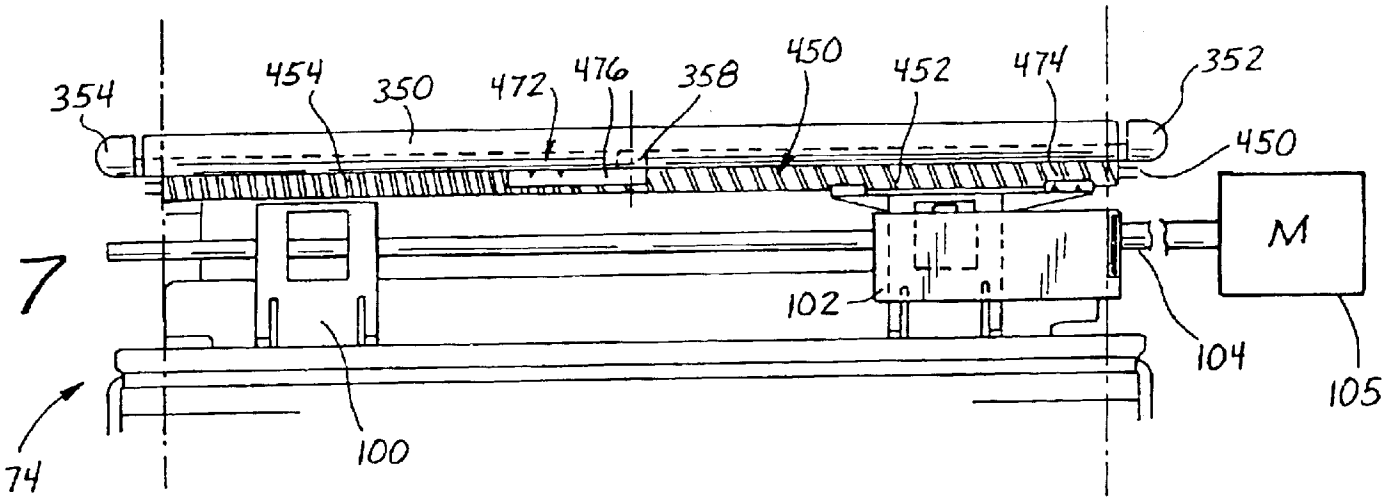
FIG. 7 shows a frontal elevation view of the lead screw and print head adjustment apparatus in the direction of lines 7—7 of FIG. 6.
Figure 8:
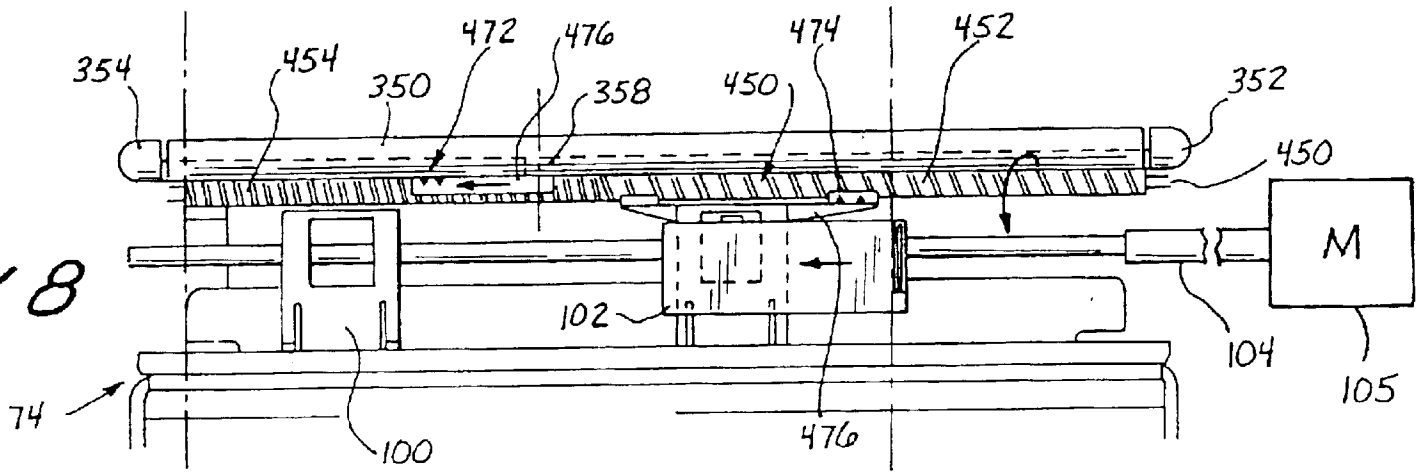
FIG. 8 shows an adjustment end movement of the print head support and width adjusting means after an adjustment for narrower width has been made from that of FIG. 7.

Inasmuch as the edge of the print ribbon 120 is to the left side as seen in FIGS. 7 and 8, the block 100 should move only half as far as the block 102 in order to accommodate for proper print head 74 pressure. In order to do this, a traveler or nut, whether it be a semi-circular nut or other type, is shown connected to each block and to the lead screw 450. For instance, block 100 has a nut like member or traveler 470 connected to the lead screw threads 454. As can be seen, phantom teeth or threads have been shown through a section in the way of teeth 472 that engage the threads 454.

Teeth 474 engage threads 452 and are on a second nut or traveler 476 connected to block 102 which provides the spring plate function of spring plate 401 downwardly against the print head 74. Here again, it is not necessary that the nuts or travelers 470 and 476 be connected to the blocks 100 and 102 respectively. However, when the lead screw 450 is turned, it serves to accommodate the placement of the blocks 100 and 102 into a uniform position if they are so connected.

The function of the dual pitched lead screw 450 is to move the block 102 as well as the gimbal pin 358 for uniform reaction of the roller 350 to the ribbon 120. This movement of the pin 358 to a centered location over the web of print ribbon 120 sets the roller into a position to provide self aligning support for the ribbon. This in turn allows the handling of striations and imperfections across the web of the ribbon 120.

Of substantially significant consideration is the fact that as the nut 470 moves to the left as seen in FIG. 8 when the lead screw is turned in the direction of the arrows, it moves the pin 358 within the slot 366 to the left. This serves to orient the edge 360 of the pin 358 against the surface of the slot 366 for proper balancing and pivoting of the gimbal plate 356 with the roller 350 thereon. In this manner, the roller 350 adjusts as to its centering and self alignment to the travel of the print ribbon 120 thereover in such a manner to compensate for printer irregularities. The index point can be taken from the edge of the ribbon 120 and the pin 358 moved into its self aligning position by manual movement or an electro optic sensor, contact sensor, or proximity sensor of any suitable type that controls a motor to move the lead screw for pin orientation.

The gimbal plate pin 358 can be moved on the nut or traveler 470 in any suitable manner such as by the knob 486 connected to the shaft of the lead screw 450. Also, the lead screw 450 can be moved and controlled by a motor means 490 shown in FIG. 11 connected to a gear 492 which turns the shaft of the lead screw 450. Motor 490 can be controlled to move the gear 492 in either direction so that the lead screw 450 can cause the gimbal pin 358 which provides centering to move to a proper location with regard to the print ribbon 120.

As can be appreciated, the print ribbon when traveling over the roller 350 causes the self aligning movement in the direction of arrows D depending on the relative differences of the contacting ribbon 120. In order to accommodate a central location, a sensor such as an optical sensor 496 can be utilized having an optical sensing beam 498 that senses an edge or other object such as gimbal plate edge 500. The gimbal plate edge 500 can be utilized to set the gimbal plate at the properly centered location for the travel of the print ribbon 120 thereover. The positioning can also be based upon a reading of the position of the edge of the ribbon 120. In this manner variously sized ribbons can be utilized and compensated for.

As the plate 356 moves it causes variations in centering that can be compensated for. The motor 490 can drive the lead screw 450 on a dynamic basis to place the gimbal plate 356 in a centered location by moving the pin 358 along slot 366. This serves to center the edge point 360 against the slot 366 so as to effect the proper centering location of the gimbal plate 356 and roller 350 connected thereto. The net result is improved support and alignment of the print ribbon 120 as it moves over the edge of the roller 350. The dynamic drive can be controlled by a controller such as controller 178 or by the host 620. Here again this movement can be combined with, or controlled by indexing from off of the edge of the ribbon 120 by an optical sensor, such as sensor 496.

The various widths of the print ribbon 120 can be accommodated by moving the lead screw 450 so as to cause the nuts or travelers 470 and 474 to move the roller 350 into a centered position. This allows for the pin 358 to be centered and then controlled dynamically to maintain the gimbal plate 356 in proper, or self alignment to provide support to the print ribbon and self alignment at the center point thereof. Here again the drive can be controlled by a controller such as controller 178, or by operator inputs from the panel 182. Also the input as to width of the ribbon 120 can be controlled and derived from the host computer 620, or the panel 182, and then accommodated by movement of ribbon width motor 490.

The controls and input for the respective printing functions as to automatic control can be provided through a host computer 620 or the printer panel 182.

The file system 600 can be either a FLASH, EEPROM, DISC NVRAM or any other non-volatile memory device. This memory is controlled by the file system driver 602. The memory can contain the desired settings needed for the print head pressure driver 604, ribbon tension driver 606, print intensity driver 608 and/or ribbon width driver 610. It should be born in mind that the functions that have previously been set forth insofar as items 604 through 610 are provided in hardware and software. For instance, the ribbon tension driver 606 is provided by motors 220 and 230 that are driven as to the BEMF stated hereinbefore to provide the ribbon tension motors 628 function as set forth hereinafter. The current settings 612 are able to be set by the data in the file system 600.

The control panel 182 is a user interface that contains keys 184 for user input and a display for user output. This control panel 182 interfaces with the control panel driver 616. The control panel 182 also allows the user to modify the settings needed for the print head pressure driver 604, ribbon tension driver 606, printer intensity driver 608, and/or ribbon width driver 610. The current settings 612 are able to be set by the user with the control panel 182. These functions can also be controlled automatically by the host 620 and controller 178.

The host computer 620 is the computer system of the user that sends data to the thermal printer for printing. All data coming from or going to the host computer 620 is handled by the host input/output driver 622. The host computer 620 is able to send commands to the printer to modify the settings needed for the print head pressure driver 604, ribbon tension driver 606, print intensity driver 608, and/or ribbon width driver 610. The current settings 612 are able to be set by the host computer 620 as well as the other controls such as the controller 178 and control panel 182.

The current settings are the values of the engine control software 624 that can be collectively referred to as the software provided in the controller 178 and other support processors used to control the print head pressure driver 604, ribbon tension driver 606, print intensity driver 608, and ribbon width driver 610.

The engine control software 624 is software that controls the print head pressure driver 604, ribbon tension driver 606, print intensity driver 608, and ribbon width driver 610 as to their respective functions during the printing and adjusting processes on a remote automated basis.

The print head pressure driver 604 moves the print head pressure motor 105. As previously stated, this pressure motor 105 moves the print head into various proximities to the platen 48 for applying various pressures upon the platen as to the print ribbon 120 and the media.

The ribbon tension driver 606 is the system that moves the ribbon motors 628 which can be defined as the motors 220–230 which are controlled by the software of the controller 178.

In order to provide variations in print intensity through the heat of the print head 74, a print intensity driver 608 is utilized. This drives the print head 74 based upon desired print head temperatures as sensed by print head temperature sensor 638. Various means for calculating the print head temperature sensor can be utilized and cause the print head 74 to function with respect to providing the various pixels through its heating elements.

The ribbon width driver 610 is the system that moves the ribbon width motor 490. This movement of the ribbon width motor 490 can control not only the support and transport function by the gimbal members, but also accommodates variously sized ribbon not only from the standpoint of transport but also from the standpoint of inertia, size, and relative values so that motors 220 and 230 can move responsively to provide print ribbon 120 transport in a properly tensioned and supported manner.

The ribbon remaining sensor 634 is a sensor that detects how much ribbon is remaining. This information is sent back to the current status 636. The ribbon remaining sensor 634 relies upon the calculations performed as shown in FIG. 14 regarding the various functions of sensing through either speed of the motors 620 and 630, or optical and mechanical sensors.

The print head temperature sensor 638 is a sensor that detects the temperature of the print head 74. This information as previously stated is sent back to the current status 636.

The ribbon width sensor 496 is the sensor that detects the width of the ribbon. This information is sent back to the current status 636 and is part of the input for purposes of driving the ribbon width motor 490 to adjust for the size of the ribbon width such as 4, 6, or 8 inch wide ribbon.

The media usage sensor 646 is provided by either the calculations performed in FIG. 14 or can be a specific sensor that detects the amount of media remaining. This information is sent back to the current status 636 in order to provide for an output on the printer control panel 182 or control the actual printer itself in its functions.

The current status 636 is the current status of the amount of ribbon remaining, temperature of the print head 74, width of the ribbon 120, and amount of media on the spool 38 which remains unused. This information is able to be sent to the control panel driver 616 interfacing with the printer control panel 182. The output can be displayed for use on the printer control panel 182 or can be sent to the host computer 620 through the host input/output driver 622.

Figure 13:
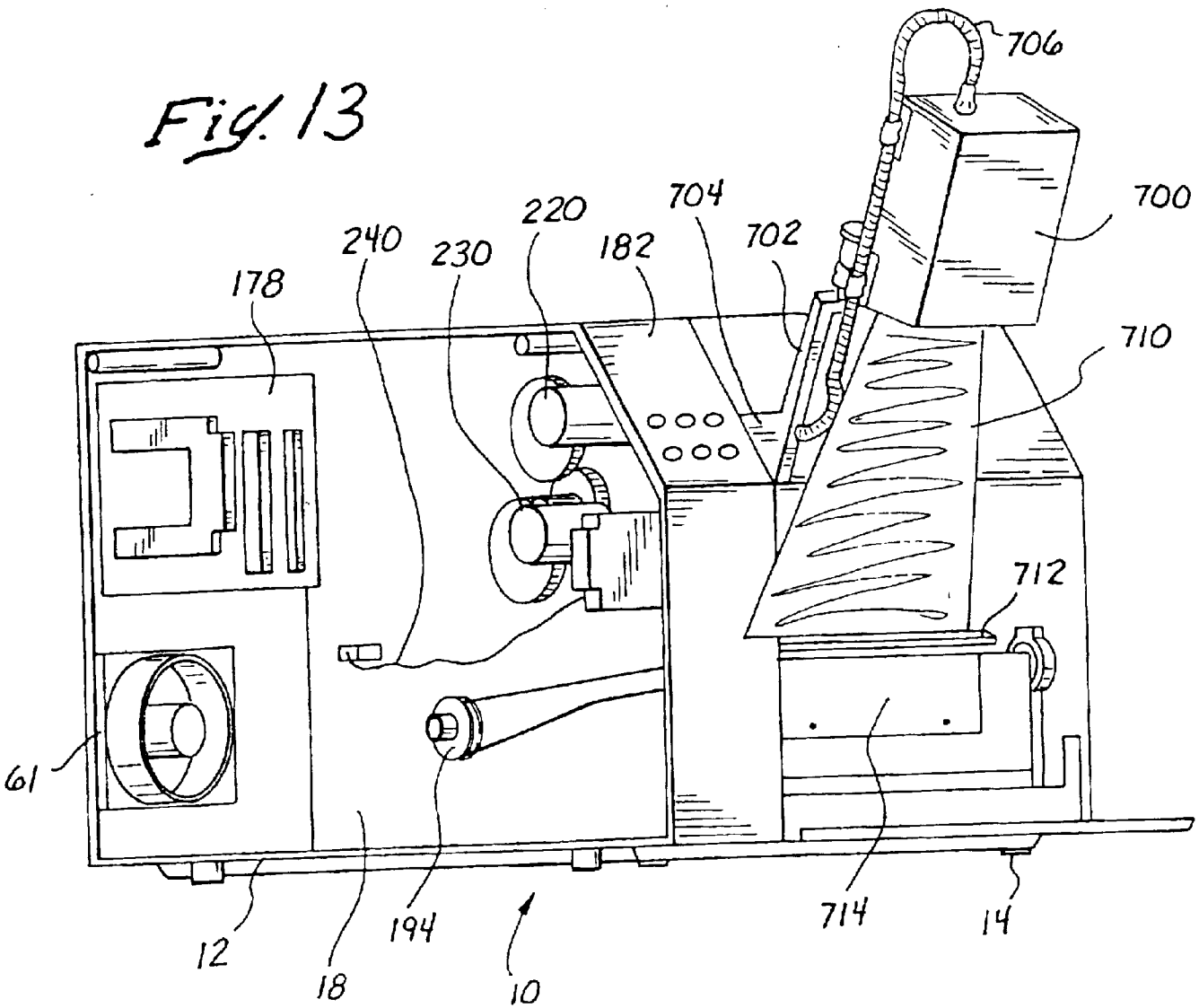
FIG. 13 shows a perspective view of a printer adapted with a bar code reader and verifier.

In order to effect verification of printing such as the accuracy of a bar code through a verifier, it can be seen in FIG. 13 that a verifier 700 has been provided. The verifier 700 is mounted on a mounting system including bracket 702 held by a printer connecting bracket 704 to the printer. The printer of FIG. 13 has been shown in a less detailed manner showing the controller with the interconnecting lines 240 to the verifier as well as a fan 61, wall 18, and the other functions as set forth hereinafter including the control panel 182. The verifier 700 has a cable 706 connected to the line 240 that feeds back to the host 620 or controller 178.

The verifier functions by means of casting a scanning beam 710 over the media 712 that has been printed with a bar code or other symbols including alpha numeric symbols. The residue media rolls off in the form of stripped media 714. The readings by the verifier 700 are transmitted by cable 706 as to the aspects of whether the bar code or other alpha numeric symbols are in accord with the logic of the host 620 and controller 178 or any particular input such as through panel 182.

The verifier checks on items in a bar code such as whether there is encodation failure, quiet zone failure, proper symbol contrasts, the percent of decode, the number of defects, and whether or not there can be sufficient decodability or any failure thereof. Also, the verifier can provide reports of the quality of the bar code being printed on the media 712 by scanning it through scanner 710.

This output through cable 706 to the host computer 620 or controller 178 can then be utilized for purposes of controlling print head pressure intensity and width or other functions as set forth in the foregoing specification.

As a consequence, this invention has significant bearing with regard to many aspects of thermal printers.

What is claimed is:

1. A thermal printer having a thermal printer head and a platen over which various width print ribbons pass between them comprising:

at least one pivotal support across the width of a print ribbon before or after the passage of said print ribbon over said printer head which can be oriented to provide central pivotal support with respect to the width of said print ribbon;

sensor to determine the width of said print ribbon;

a processor in said thermal printer responsive to the width of the print ribbon;

a ribbon width driver connected to said processor; and, a ribbon width motor for moving said pivotal support along the various widths of print ribbon to an approximately center position along the width of each print ribbon.

2. The thermal printer of claim 1, further comprising:

support for a spool of media; a rotatable print ribbon supply spindle for a print ribbon supply spool;

a rotatable take-up spindle for taking up print ribbon and forming a take-up spool from said supply spool as it moves in association with said media between said platen and printer head;

a motor connected to said print ribbon supply spindle having a Back EMF (BEMF);

a ribbon tension driver;

a motor connected to said take-up spindle;

a second processor to provide current settings and engine control to said ribbon tension driver to provide movement and continuous tension of said print ribbon by controlling the movement of said motors during supply and take-up movement of said ribbon;

a print head motor to position said printer head with respect to said platen;

a driver for driving said print head motor; and a third processor for controlling the amount of pressure by said print head motor placed on said print head in association with said platen.

3. The thermal printer as claimed in claim 2, wherein:

said second processor calculates a desired tension on said print ribbon on said supply spindle, and tension on print ribbon of said take-up spindle and adjusts their respective velocities.

4. The thermal printer as claimed by claim 2 wherein said second processor calculates a desired tension of the print ribbon on said print ribbon supply spool and said take-up spool and adjusts their respective motor torques.

5. The thermal printer as claimed in claim 2 wherein: said second processor calculates a desired movement of said supply spool based upon the Back EMF (BEMF) of the motor connected thereto.

6. The thermal printer as claimed in claim 2 further comprising:

a fourth processor for determining the amount of ribbon remaining on the respective supply spool and take up spool by calculating the axial velocity of each spool.

7. The thermal printer as claimed in claim 6 further comprising:

a printer control panel; and, a sensor for providing an output as to the amount of ribbon remaining through current status software connected to said printer control panel.

8. The thermal printer as claimed in claim 2 further comprising:

a print head temperature sensor;

a print intensity driver connected to said print head for providing appropriate temperature of said print head for printing; and, a fifth processor with current settings for controlling said print intensity driver based upon input from said print head temperature sensor.

9. The thermal printer as claimed in claim 2 further comprising:

a motor for adjusting the printer as to the width of the print ribbon; and, a sixth processor for controlling the ribbon width driver based upon an input from a host computer, a control panel, or an on board controller.

10. The thermal printer as claimed in claim 2 wherein said second processor having a media usage output based upon the radial velocity of at least one motor.

11. The thermal printer of claim 1, further comprising:

a temperature sensor to determine the temperature of said printer head;

a print intensity driver; and, a second processor connected to said print intensity driver for changing the heat of said print head in response to print head temperature.

12. The thermal printer of claim 1, wherein said printer head has heating elements for dot matrix printing, further comprising:

a temperature sensor to determine the temperature of said printer head with respect to said heating elements;

a print intensity driver; and, a processor connected to said print intensity driver for changing the heat of said printer head heating elements in response to temperature.

13. The thermal printer as claimed in claim 12 wherein;

said print intensity driver is connected to engine control software which is established by current settings and a pre-established input based upon a desired degree of intensity of the print of said printer.

14. The thermal printer system as claimed in claim 12 further comprising:

a printer verifier which is placed in association with said thermal printer to read printed media and in connected relationship to said print intensity driver to change the heat on the printer head depending upon pre-established printing criteria.

15. The thermal printer as claimed in claim 1 further comprising:

input means to said processor with regard to pre-established widths of print ribbon.

16. The thermal printer as claimed in claim 1 wherein:

said ribbon width sensor as connected to said processor causes a change of the positioning of said support as said ribbon moves over said support to accommodate for variances in ribbon size within a single ribbon.

17. A thermal printer comprising:

a media support for holding media that is to be printed upon;

a spindle for holding and collecting print ribbon of various widths used to print upon said media;

a print head in associated relationship with a platen between which said media and print ribbon can be moved for printing on said media;

at least one centrally oriented pivotal support for said print ribbon before or after said print ribbon passes over said print head pivotally held for support across the width of said ribbon;

a drive for moving the pivotal support along the various widths of print ribbon to an approximately center position along the width of each print ribbon; and, a processor associated with said drive for causing said drive to move in response to ribbon width and the center of pivotal support.

18. The thermal printer as claimed in claim 17 wherein:

said pivotal support is a roller.

19. The thermal printer as claimed in claim 17 wherein:

said pivotal support is a plate curved in cross-section.

20. The thermal printer as claimed in claim 17 further comprising:

an electronic control for moving the pivotal center automatically with respect to the edge of said ribbon.

* * * * *